United States Patent [19]

Mettler et al.

[11] 3,968,547

[45] July 13, 1976

[54] YARN SINGEING MACHINE HAVING A CLEANING DEVICE

[75] Inventors: Hermann Mettler; Paul Aschwanden, both of Arth, Switzerland

[73] Assignee: Aktiengesellschaft Fr. Mettler's Sohne Maschinenfabrik, Switzerland

[22] Filed: Mar. 20, 1975

[21] Appl. No.: 560,495

[30] Foreign Application Priority Data

Mar. 27, 1974 Switzerland ..... 4251/74

[52] U.S. Cl. ..... 28/63; 28/71.3

[51] Int. Cl.² ..... D02J 3/16; D06C 9/00

[58] Field of Search ..... 28/63, 71.3, 55.2; 26/3, 4, 5, 6

[56] References Cited

UNITED STATES PATENTS 3,398,518 8/1968 Nimtz et al. ..... 28/63 X

FOREIGN PATENTS OR APPLICATIONS 741,144 11/1955 United Kingdom ..... 28/63

*Primary Examiner*—Louis K. Rimrodt

*Attorney, Agent, or Firm*—McGlew and Tuttle

[57] ABSTRACT

A yarn singeing machine includes a singeing burner and a cleaning device and yarn is directed from a yarn supply to the singeing burner and the cleaning device and then to yarn winding means. The construction includes deflecting roller means for deflecting the yarn into a lengthened run between the burner and the cleaning device and also between the cleaning device and the yarn winding means.

3 Claims, 1 Drawing Figure

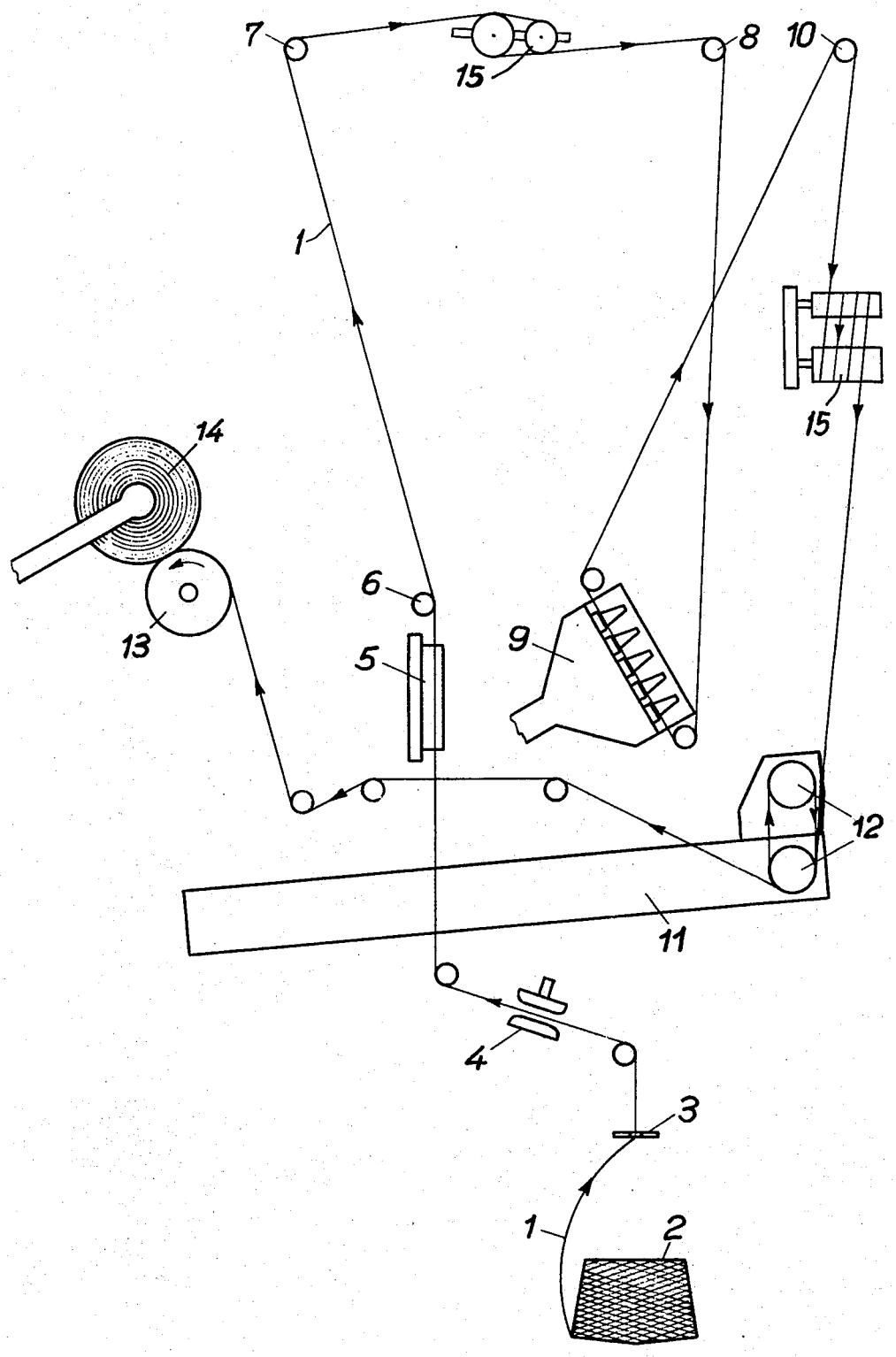
7
8
10
15
1
15
14
6
13
5
9
12
11
4
3
1
2

YARN SINGEING MACHINE HAVING A CLEANING DEVICE

FIELD AND BACKGROUND OF THE INVENTION

This invention relates in general to the construction of yarn singeing machines and, in particular, to a new and useful yarn singeing machine which includes means for deflecting the yarn into a lengthened pass in its run between the yarn singeing burner and a cleaning device and between a cleaning device and the means for winding the yarn.

DESCRIPTION OF THE PRIOR ART

In the known singeing devices for yarn, difficulties arise as soon as the installation requires not only singeing, but also another processing operation which is designed to be performed simultaneously and which is included in, or associated with, the singeing process. Should it be desired, for example, to wind the yarns or tubes after singeing, or to form cones suitable for dyeing, it is advisable to clean the yarns from the singeing residues prior to the winding of the packages for dyeing. However, when a cleaning device is used after singeing, it is likely that it would brake the running yarn to such an extent that the winding of faultless dye or normal spools having a usual hardness would not be ensured in a satisfactory manner.

Threads made of entirely synthetic material cannot be fed into a cleaning device immediately after the singeing because such threads must be cooled down first, and this requires a great amount of space of movement of the thread running from the burner to the cleaning device. In view of the reduced space which is available, the thread cannot run in a straight line, but is conducted around various deflecting points and must overcome the rolling frictions and sliding resistances which are present. Even without a cleaning device, this results in additional tensions in the thread with yarns processed in this manner so that problems may arise during the winding, particuarly as to the structure of the package, that is, in respect to its shape and hardness.

Yarn drawing is an operation which may also be combined with another process and may be performed in the yarn singeing machine before or after the singeing operation. However, such treatment or the similar treatment of threads in addition to singeing will cause an increased tension in the thread resulting in undesirable effects.

SUMMARY OF THE INVENTION

The present invention provides a yarn singeing machine which eliminates the difficulties of the known constructions, and is directed to an arrangement permitting cooling of the thread, cleaning and, if desired, also a drawing of the yarn. For this purpose, in accordance with the invention, deflecting means are provided for lengthening the run of the yarn between the burner and the cleaning device and between the cleaning device and the wind-up station.

Accordingly, it is an object of the invention to provide a yarn singeing device which includes means for lengthening the run of a yarn between the burner and the cleaning device and between the cleaning device and the wind-up station.

A further object of the invention is to provide a yarn singeing device which is simple in design, rugged in construction, and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

BRIEF DESCRIPTION OF THE DRAWING

The only FIGURE of the drawing is a schematic representation of a yarn singeing machine constructed in accordance with the invention.

DESCRIPTION OF THE PREFERRED EMBODIMENT

Referring to the drawing in particular, the invention embodied therein, comprises a yarn singeing machine in which yarn 1 is fed from a yarn supply or bobbin 2 and passes through a thread guide 3 at a break mechanism 4 to a singeing burner 5.

In accordance with the invention, the yarn runs around deflection rollers 6, 7 and 8 to a cleaning device 9 and it is cooled down during this passage.

In accordance with another feature of the invention, upon leaving cleaning device 9, the yarn is run around a further deflecting roller 10 and its travelling path is thereby lengthened once more. From roller 10, the yarn passes to a yarn delivery mechanism 11 which is equipped with advance rollers 12. Between roller 10 and yarn delivery mechanism 11, the yarn residues, which have been loosened in the cleaning device, are caused to fall off due to the vibration of the running yarn.

The yarn runs after it runs through the delivery mechanism 11 and around the advance rollers 12 to yarn winding means which include a spool 14 onto which the yarn is wound after passing over a thread guiding drum 13.

The yarn delivery mechanism 11 reduces the thread tension to a minimum and delivers the yarn with any desired and adjustable tension to the wind-up means which includes the winding drum 13 and a spool 14. By control of the delivery mechanism, the yarn may be wound so as to obtain uniformly wound packages which may be either soft or hard. It may also be useful to provide a thread drawing device in advance of the entrance of the yarn into the burner or after the entrance of the yarn into the burner as shown at 15 (in end direction) and at 15' (in side direction).

While a specific embodiment of the invention has been shown and described in detail to illustrate the application of the principles of the invention, it will be understood that the invention may be embodied otherwise without departing from such principles.

What is claimed is:

1. A yarn singeing machine, comprising a singeing burner, a yarn cleaning device, yarn winding means for winding treated yarn onto a spool, a yarn supply, a yarn brake for braking the movement of said yarn, a yarn delivery mechanism having a plurality of advance rollers around which the yarn is directed, deflecting means deflecting the yarn into a lengthened run between said burner and said cleaning device and between said cleaning device and said yarn winding means, said brake and said delivery mechanism comprising yarn tension reducing means, and means for directing said yarn from said yarn supply through said yarn brake, said burner, said cleaner, said deflecting means, said delivery mechanism and to said yarn winding means.

2. A yarn singeing machine, according to claim 1, wherein said yarn delivery mechanism has advance rollers located between said cleaning device and said yarn winding means.

3. A yarn singeing machine, according to claim 1, including a thread drawing mechanism between said burner and said yarn winding means over which the yarn is drawn.

* * * * *